US010273031B2

(12) United States Patent
Fenn

(10) Patent No.: US 10,273,031 B2
(45) Date of Patent: Apr. 30, 2019

(54) PACKAGING APPARATUS AND METHOD FOR OPERATING SAME

(71) Applicant: Signode Industrial Group LLC, Glenview, IL (US)

(72) Inventor: Carsten Fenn, Sonderborg (DK)

(73) Assignee: Signode Industrial Group LLC, Glenview, IL (US)

( * ) Notice: Subject to any disclaimer, the term of this patent is extended or adjusted under 35 U.S.C. 154(b) by 615 days.

(21) Appl. No.: 15/007,634

(22) Filed: Jan. 27, 2016

(65) Prior Publication Data

US 2016/0221703 A1 Aug. 4, 2016

(30) Foreign Application Priority Data

Feb. 2, 2015 (DE) ..... 10 2015 101 489

(51) Int. Cl.

| | |
|---|---|
| ***B65B 65/02*** | (2006.01) |
| ***B65B 59/04*** | (2006.01) |
| ***B65B 9/13*** | (2006.01) |
| ***B65B 11/02*** | (2006.01) |

(52) U.S. Cl.

CPC ..... *B65B 65/02* (2013.01); *B65B 9/135* (2013.01); *B65B 11/02* (2013.01); *B65B 59/04* (2013.01)

(58) Field of Classification Search

CPC .. B65B 9/10; B65B 9/13; B65B 9/135; B65B 9/14; B65B 11/54; B65B 59/00; B65B 59/04; B66F 9/0655; B66F 9/08

USPC ..... 53/459, 167, 567; 254/4 R, 134, 128; 414/788, 799, 914, 927

See application file for complete search history.

(56) References Cited

U.S. PATENT DOCUMENTS

| | | | |
|---|---|---|---|
| 2,711,803 | A | 6/1955 | Hurst et al. |
| 2,745,688 | A | 5/1956 | Farrington et al. |
| 2,758,898 | A | 8/1956 | Kobsch |
| 2,797,634 | A | 7/1957 | Rueckert |
| 2,942,797 | A | 6/1960 | Lorenz et al. |
| 3,016,869 | A | 1/1962 | Anderson et al. |
| 3,190,457 | A | 6/1965 | Linden |

(Continued)

FOREIGN PATENT DOCUMENTS

| | | |
|---|---|---|
| CN | 101 830 292 | 9/2010 |
| DE | 2256753 | 5/1974 |

(Continued)

OTHER PUBLICATIONS

European Search Report for European Application No. 16151132.4 dated Jun. 17, 2016 (5 pages).

*Primary Examiner* — Hemant Desai
*Assistant Examiner* — Valentin Neacsu
(74) *Attorney, Agent, or Firm* — Neal, Gerber & Eisenberg LLP

(57) ABSTRACT

Various embodiments of the present disclosure are directed to a packaging apparatus and method for packaging an article with a tubular film to be pulled over the article. The packaging apparatus has a machine frame on which a film supply apparatus and a film covering apparatus are mounted. The packaging apparatus includes a releasable drive coupling usable to operatively couple a drive with either the film covering apparatus or the film supply apparatus (or a subcomponent of the film supply apparatus). Once coupled, the drive can move the film covering apparatus or the film supply apparatus relative to the frame.

19 Claims, 17 Drawing Sheets

(56) References Cited

U.S. PATENT DOCUMENTS 3,278,059 A 10/1966 Ridgeway et al.
3,436,046 A 4/1969 Valeska
3,507,137 A 4/1970 Taleff et al.
3,626,654 A 12/1971 Hoffler et al.
3,679,244 A 7/1972 Reddy
3,852,937 A * 12/1974 Bitsura ..... B65B 9/135 53/386.1
3,902,303 A * 9/1975 King ..... B65B 9/135 53/261
3,944,045 A * 3/1976 Higgins ..... B65B 9/135 198/340
4,050,219 A * 9/1977 Higgins ..... B65B 9/135 53/567
4,063,401 A * 12/1977 Higgins ..... B65B 9/135 53/567
4,067,174 A 1/1978 Goldstein
4,204,377 A 5/1980 Lancaster et al.
4,235,062 A 11/1980 Lancaster, III et al.
4,317,322 A 3/1982 Lancaster et al.
4,473,990 A * 10/1984 Thimon ..... B65B 9/135 53/442
4,587,796 A 5/1986 Haloila
4,588,142 A 5/1986 Malzacher
4,619,193 A 10/1986 Crew
4,631,898 A 12/1986 Brambilla
4,754,594 A 7/1988 Lancaster
4,756,143 A 7/1988 Lancaster
4,905,451 A 3/1990 Jaconelli et al.
4,905,488 A 3/1990 Plitt
4,914,891 A 4/1990 Suolahti
4,939,989 A 7/1990 Zacharias
5,107,657 A 4/1992 Diehl et al.
5,140,795 A 8/1992 Steding
5,154,382 A 10/1992 Hoshino
5,195,297 A 3/1993 Lancaster et al.
5,216,871 A 6/1993 Hannen
5,463,843 A 11/1995 Sharp
5,619,838 A 4/1997 Kasel
5,623,808 A 4/1997 Franklin et al.
6,032,439 A * 3/2000 Birkenfeld ..... B65B 9/135 53/441
6,237,307 B1 5/2001 Zentmyer et al.
6,298,636 B1 * 10/2001 Lachenmeier ..... B65B 9/135 53/442
6,470,654 B1 * 10/2002 Lachenmeier ..... B65B 9/135 53/459
6,516,591 B1 2/2003 Lancaster, III et al.
6,539,690 B2 4/2003 Alvarez
6,619,872 B2 9/2003 Crorey et al.
6,622,620 B1 9/2003 Byington
6,725,625 B1 4/2004 Honma et al.
6,865,865 B2 3/2005 Hannen et al.
6,945,163 B2 9/2005 Squyres
7,036,289 B2 5/2006 Suolahti
7,040,071 B2 5/2006 Heikaus
7,040,076 B2 5/2006 Lachenmeier et al.
7,234,289 B2 6/2007 Hannen et al.
7,325,487 B2 2/2008 Squyres
7,367,740 B2 5/2008 Lazic et al.
7,533,515 B1 5/2009 Koskela
7,707,801 B2 5/2010 Lancaster, III
7,707,802 B2 5/2010 Forrest
7,908,831 B1 3/2011 Dugan
7,913,476 B2 * 3/2011 Lachenmeier ..... B65B 59/04 53/393
7,937,910 B2 5/2011 Jaconelli et al.
7,966,790 B2 * 6/2011 Michels ..... B65B 9/135 53/441
7,975,456 B2 * 7/2011 Lachenmeier ..... B65B 9/135 53/441
8,141,327 B2 3/2012 Lancaster, III
8,147,654 B2 4/2012 Sawada et al.
8,347,784 B2 1/2013 Herrmann
8,453,420 B2 6/2013 Schmidt et al.
D693,982 S 11/2013 Lachenmeier et al.
8,875,480 B2 11/2014 Czok
8,938,939 B2 1/2015 Roche
D749,815 S 2/2016 Lachenmeier et al.
9,440,756 B2 9/2016 Michels
9,776,746 B2 * 10/2017 Tellen ..... B65B 11/02
10,093,439 B2 10/2018 Lachenmeier et al.
2001/0046409 A1 11/2001 Fischer
2002/0033005 A1 * 3/2002 Lachenmeier ..... B65B 9/135 53/459
2003/0156891 A1 8/2003 Hung et al.
2004/0107677 A1 * 6/2004 Hannen ..... B65B 9/135 53/459
2006/0005511 A1 1/2006 Suolahti et al.
2006/0040085 A1 2/2006 Downs et al.
2006/0285915 A1 12/2006 Dellach et al.
2007/0140817 A1 * 6/2007 Hansl ..... B66F 9/063 414/277
2007/0157557 A1 7/2007 Lancaster, III
2007/0163207 A1 7/2007 Chiu Chen
2009/0217624 A1 * 9/2009 Forrest ..... B65B 11/006 53/399
2009/0229226 A1 9/2009 Beeland et al.
2009/0272080 A1 * 11/2009 Lachenmeier ..... B65B 9/135 53/461
2009/0293425 A1 12/2009 Carter et al.
2010/0018165 A1 1/2010 Kudia
2010/0071317 A1 * 3/2010 Michels ..... B65B 9/135 53/441
2010/0163443 A1 7/2010 Storig et al.
2010/0258241 A1 10/2010 Perecman
2011/0146210 A1 * 6/2011 Michels ..... B65B 9/135 53/461
2011/0258973 A1 * 10/2011 Czok ..... B65B 9/135 53/473
2014/0013714 A1 1/2014 Lachenmeier et al.
2014/0053502 A1 2/2014 Pecchenini et al.
2014/0137516 A1 5/2014 Lachenmeier et al.
2014/0230380 A1 * 8/2014 Geerts ..... B65B 59/04 53/556
2014/0250831 A1 9/2014 Suolahti et al.
2015/0113920 A1 4/2015 Koskela et al.
2015/0232214 A1 8/2015 Suolahti et al.
2015/0251792 A1 9/2015 Koskela et al.
2015/0321781 A1 11/2015 Kristensen et al.
2017/0157880 A1 6/2017 Eckermann et al.

FOREIGN PATENT DOCUMENTS

DE 3101310 12/1981
DE 3918311 12/1989
DE 3914595 11/1990
DE 20101909 6/2002
DE 102005037916 5/2006
DE 102005003783 8/2006
DE 10 2005 062 609 7/2007
DE 20 2007 018 900 8/2009
DE 102010037770 6/2012
DE 10 2011 000 205 7/2012
DE 10 2012 024 176 6/2014
EP 0 621 184 10/1994
EP 0 653 352 5/1995
EP 0 811 554 12/1997
EP 1 033 305 9/2000
EP 1060988 12/2000
EP 1 097 867 5/2001
EP 1 266 828 12/2002
EP 1 266 829 12/2002
EP 1 454 827 9/2004
EP 1 542 192 6/2005
EP 1 574 432 9/2005
EP 1574432 9/2005
EP 2 060 492 5/2009
EP 2 069 209 6/2009
EP 2 199 214 6/2010
EP 2 792 599 10/2014
FI 78433 4/1989
FI 91624 4/1994

(56) References Cited

FOREIGN PATENT DOCUMENTS

| | | |
|---|---|---|
| FR | 1 396 355 | 4/1965 |
| GB | 2 395 165 | 5/2004 |
| JP | 2002104308 | 4/2002 |
| JP | 2013154956 | 8/2013 |
| WO | 02/812065 | 2/2002 |
| WO | WO 2004/045952 | 6/2004 |
| WO | WO 2006/085147 | 8/2006 |
| WO | 2006/110596 | 10/2006 |
| WO | 2008/031449 | 3/2008 |
| WO | 2010/078915 | 7/2010 |
| WO | 2012/027705 | 3/2012 |

* cited by examiner

PACKAGING APPARATUS AND METHOD FOR OPERATING SAME

This application claims priority to and the benefit of German Patent Application No. 10 2015 101 489.0, filed on Feb. 2, 2015, the entire contents of which are incorporated herein by reference.

The present disclosure relates to a packaging apparatus for packaging at least one article with a tubular film to be pulled over the article and a method for operating such a packaging apparatus.

For this purpose, the packaging apparatus has a machine frame on which a film supply apparatus, a film covering apparatus that is movable in the vertical direction, and a drive for moving the film covering apparatus are arranged. Packaging apparatuses of this type are known and are referred to, depending on the design, as a stretch hood system or a shrink hood system.

In general, such packaging apparatuses are used for securing articles on a pallet by way of a film, also to protect the articles from external influences. However, the packaging may also take place without a pallet. The film used is generally a highly stretchable plastic tube that is pulled from above over the article. The film supply apparatus ensures that the tubular film is available to the film covering apparatus in the required length. The severed piece of film is subsequently taken over by the film covering apparatus. The film covering apparatus customarily has reefing fingers that expand the elastic film tube by moving the elastic film tube apart until the film tube can be pulled over the article. For this purpose, the film covering apparatus moves downward, with the expanded film tube then being pulled (by way of reefing rollers) off the reefing fingers onto the article. In the case of a stretch hood system, the elastic film contracts again after being pulled off the reefing fingers and thus secures the article. In the case of the shrink hood method, the film is shrunk on by heating.

To be able to move the film covering apparatus in at least one desired direction (generally vertically, but movements in other directions, for example in a horizontal direction for maintenance in a lateral position of the machine frame, are also conceivable), the known apparatuses generally have at least one drive. The drive can have a piston and/or a motor. The piston and/or the motor then drives a belt, a chain, a cable, a linkage, or the like that is operatively connected with the film covering apparatus.

As a rule, the film supply apparatus has subcomponents, such as a film store, a film feed apparatus, a film opening apparatus, a cutting apparatus, and/or a welding apparatus.

The film store is understood here as meaning any type of reservoir in which film is stored. This can be, for example, a film reel from which a required piece of film is unwound.

The film feed apparatus has rollers that are generally driven and that, by way of the rotation thereof, transport further film.

The film opening apparatus can be formed, for example, from "suction boxes". The "suction boxes" generate a suction force and thereby ensure that the film is opened. However, mechanical solutions, such as grippers with which the film is opened, are also conceivable. The reefing fingers of the film covering apparatus can then later engage from the inside into the opened film tube.

The cutting apparatus then severs the required portion of the film tube from the remainder thereof. This can take place, for example, with a knife or a thermal cutting wire.

The welding apparatus permits welding of the cut-off end of the film tube. A film hood can thus be produced. Such a film hood protects the article even better upward and also permits the application of vertical retaining forces to the article.

The film supply apparatus and the subcomponents thereof are generally arranged on the machine frame at least for the most part above the article to be packaged. However, for maintenance or repair purposes, it is occasionally necessary for a fitter to approach the film supply apparatus or the subcomponents thereof to be able to carry out work there. Since the film supply apparatus or the subcomponents thereof is or are generally located at a height of some meters above the ground, such maintenance is frequently laborious and possibly also dangerous since the fitter could fall off. Therefore, conventional apparatuses have working platforms with a safety barrier. However, these require space and cause additional costs in production.

EP 2069206 B1 proposes a packaging apparatus in which the film advancing device can be moved downward to maintain the film advancing device close to the ground. For this purpose, the film advancing device either has a dedicated drive for the downward movement or the film advancing device is connected to the film covering apparatus and is then moved downwards with the film covering apparatus by "piggyback" into the maintenance position.

The two solutions have proven highly practicable, but require additional and/or specially adapted components. If the film advancing device has a dedicated drive for the downward movement, additional components are required for this purpose and make the system more complicated and expensive. If the film advancing device is moved by way of the film covering apparatus by "piggyback," all of the components of the drive of the film covering apparatus have to be of such large dimensions that the film covering apparatus is also not overloaded by the additional weight of the film advancing device. However, both because of the larger dimensioning and because of the use of additional components, the production costs of the packaging apparatus increase. This is generally not desirable.

It is therefore the object of the present disclosure to reduce the production costs of such a packaging apparatus mentioned at the beginning.

This object is achieved by a packaging apparatus and by a method for operating such a packaging apparatus.

The packaging apparatus of the present disclosure is distinguished in that the packaging apparatus has at least one releasable drive coupling that is designed in such a manner that the drive can be brought into operative connection optionally either with the film covering apparatus or with at least one subcomponent of the film supply apparatus in such a manner that then either the film covering apparatus or at least the relevant subcomponent of the film supply apparatus can be moved on the machine frame by the drive.

The drive coupling here can have an abundance of conceivable design forms and mechanisms. For example, mechanical couplings or electromagnetic couplings are conceivable. One main feature is that the drive of the film covering apparatus can be released from the film covering apparatus and subsequently can be brought into engagement with at least one subcomponent of the film supply apparatus. It is mainly made possible by way of such a releasable drive coupling that both film covering apparatus and film supply apparatus can be moved by the drive of the film covering apparatus, specifically one after the other. This firstly affords the advantage that all of the components of the drive do not have to be configured in duplicate. On the contrary, the drive of the film covering apparatus can be directly used to also move the film supply apparatus or a subcomponent thereof into a maintenance position.

The drive can thus be of small dimensions. This is because the dimensioning of all of the drive components no longer has to be configured to move the overall weight of film covering apparatus and film supply apparatus, but rather is merely based on the heaviest individual component in each case to be transported. The smaller dimensioning of the drive components makes it possible to reduce the production costs of the packaging apparatuses. In addition, it is thus possible to design the packaging apparatus to be overall slimmer and lighter.

In an embodiment, the releasable drive coupling is designed in such a manner that, by actuation of the drive coupling, each existing operative connection of the drive with the film covering apparatus or with at least one subcomponent of the film supply apparatus can be undone. The drive can thus be changed in a very simple manner.

The film supply apparatus expediently has, as a subcomponent, at least one of the subcomponents already explained previously, such as a film store, a film feed apparatus, a film opening apparatus, a cutting apparatus, and/or a welding apparatus.

Each of these subcomponents has to occasionally be maintained or repaired. This is possible in a simple and safe manner by way of the packaging apparatus according to the present disclosure, since the subcomponents can be moved together, or else individually, into a maintenance position that is easy to reach, for example in the lower region of the machine frame. This increases the safety during work on the apparatus and the work can take place rapidly and in a straightforward manner.

It may be expedient here for a plurality of subcomponents of the film supply apparatus to be able to be moved together or separately from one another. This should be understood in such a manner that, for example, first of all the film feed apparatus and the film opening apparatus are moved into a maintenance position and subsequently the cutting apparatus and the welding apparatus are moved into the maintenance position in a separate step. The separate movement of the subcomponents affords the advantage that the drive components can be dimensioned to be slimmer and smaller. This is in particular the case if the weight of a plurality of subcomponents together exceeds the weight of the film covering apparatus.

Expediently, the packaging apparatus has at least one releasable first positioning coupling device with which at least one subcomponent of the film supply apparatus can be fixed on the machine frame. The first positioning coupling device is understood here as meaning any device that makes it possible to fasten the at least one subcomponent to the machine frame. This can take place, for example, by way of clamping jaws that are clamped mechanically, hydraulically, pneumatically, or electrically to the machine frame. In addition to such a frictional connection, positive connections that are produced, by, for example, latching lugs or pivoted levers, are also conceivable. Furthermore, connections that are produced, for example, by solenoids are also conceivable. By way of such a positioning coupling device, the subcomponent is then held on the machine frame in the operating mode of the packaging apparatus. In the operating mode of the system, i.e., when an article is being packaged, the subcomponents of the film supply apparatus have to be securely connected to the machine frame so that the system is functional. So that the at least one subcomponent can then also be moved into a maintenance position, the corresponding positioning coupling device, however, also has to be releasable. Only thus is a release of the connection for letting down the at least one subcomponent possible. Even in the maintenance position, it may then be expedient for at least one subcomponent to be fixedly connected to the machine frame. The drive is thereby relieved of load during the work on the apparatus. In addition, the safety during the work is thus also increased since a basically conceivable sagging of the at least one subcomponent, for example in the event of a power failure of the drive, is prevented.

The packaging apparatus advantageously has at least one releasable second positioning coupling device with which the film covering apparatus can be fixed on the machine frame. The second positioning coupling device, like the first positioning coupling device, can have a multiplicity of possible embodiments. Here too, positive, frictional or non-positive connections that, for example, come into engagement mechanically, electrically, pneumatically, or hydraulically, are again possible. The arrangement of a releasable second positioning coupling device on the film covering apparatus affords the advantage that the film covering apparatus can thereby be secured at a defined position of the machine frame. This is firstly necessary since, according to the present disclosure, the drive is separated from the film covering apparatus in order subsequently to move the film supply apparatus or at least a subcomponent thereof. In the separated state, the weight of the film covering apparatus is transported by the second positioning coupling device to the machine frame. A fixed and secure position of the film covering apparatus is thus ensured.

It may be expedient here for at least one positioning coupling device to be designed in such a manner that fixing of the film covering apparatus and/or of the at least one subcomponent of the film supply apparatus to the machine frame at different positions is possible. First of all the film covering apparatus can thus be moved to a desired height and secured there on the frame with the positioning coupling device. Subsequently, at least one subcomponent of the film supply apparatus, such as a cutting knife, can be moved into a desired maintenance position and secured there with the machine frame. After the work to the relevant subcomponent has been carried out, the subcomponent can then be moved in such a manner that work on a further subcomponent, for example the film opening apparatus, is possible at that position. It is therefore possible for the film covering apparatus or subcomponents to be brought into freely selectable positions. Depending on work to be carried out, these can be different positions on the machine frame. As a result, ergonomic, rapid, and safe work on at least one subcomponent of the film supply apparatus and the film covering apparatus is ensured.

In a development, it may be advantageous for the packaging apparatus to have at least one mounting on which the film covering apparatus can be deposited. The film covering apparatus can sit, for example in the maintenance position thereof, on at least one bearing block and can thus be secured by gravity. The mounting can be a stop on which the movable film covering apparatus sits when the film covering apparatus has been moved completely downward in the machine frame.

The drive expediently has at least one piston and/or a motor and at least one drive chain, drive cable, linkage, and/or drive belt operatively connected thereto. In particular, the combination of drive chain/drive belt/drive cable with a motor is particularly advantageous since the driven parts of the apparatus can also be moved here over large distances. In addition, such an arrangement provides the possibility of connecting a transmission between motor and drive chain/drive belt/drive cable to achieve a desired transmission ratio. Drive chain, drive cable or drive belt, or the mounting thereof on deflecting rollers, can then be configured in a targeted manner to the weight of the film covering apparatus to be transported or to the respective subcomponent of the film supply apparatus. A particularly slim and light design of the machine frame is thus possible. In addition, a chain affords the advantage that the individual links of the chain can also be directly connected to the releasable drive coupling. For example, a pin on the film covering apparatus can engage in a chain link in order thereby to produce the operative connection. The same then also applies to the operative connection between at least one subcomponent of the film supply apparatus and drive.

Furthermore, it may, however, also be advantageous for the drive coupling to have at least one drive coupling device that is arranged on the drive chain and/or on the drive belt. For example, an extendable toggle lever can be fastened to the drive chain or to the drive belt, the toggle lever, in the extended state, coming into operative connection with film covering apparatus or at least a subcomponent of the film supply apparatus and, by way of retraction, also being able to be released again. The fastening of the drive coupling device to the drive chain or to the belt affords the advantage that such a movable device does not have to be mounted in each case on the subcomponent or the film covering apparatus. On the contrary, a single device on the drive is sufficient. As a result, the number of parts of the packaging apparatus can be reduced, which ultimately reduces the production costs.

Alternatively, it may, however, also be expedient for the drive coupling to have at least one drive coupling device that is arranged on the film covering apparatus and/or at least on a subcomponent of the film supply apparatus. Such an arrangement affords the advantage that the drive chain or the drive belt can be of very slim design and a bulky apparatus does not have to be mounted here.

Furthermore, it may be advantageous for at least one drive coupling device to have a pivotable or a rigid catch lever. The operative connection between drive and film covering apparatus or at least one subcomponent of the film supply apparatus can be produced by way of such a catch lever. In the case of a pivotable catch lever, the operative connection can be produced here via the change in position of the lever. By pivoting of the catch lever, the catch lever is brought into engagement in a targeted manner. The pivoting can take place either via hydraulics, pneumatically, or via electric drives. By way of the pivoting of the catch lever, the operative connection can therefore be closed and released in a targeted manner.

It may be advantageous here for at least one drive coupling device to be designed as a counterpart to the catch lever. The drive coupling device cannot come into connection with any component of the counterpart to produce the operative connection, but rather a specifically configured component is mounted here. For example, a drive coupling device that is designed as a counterpart to the catch lever can be seen in a thickened portion on the drive chain or the drive belt, which thickened portion can come into engagement with a recess on the fixed catch lever.

Also for the pivotable catch lever, drive coupling devices as the counterpart are conceivable in many forms, for example in the form of a milled portion, in which the catch lever can engage. It is important for the counterpart to be shaped in such a manner that secure engagement of the catch lever is permitted and therefore slipping away or the like is prevented.

The catch lever here is expediently designed in such a manner that the film covering apparatus or at least one subcomponent of the film supply apparatus can be raised with the catch lever. This can take place by the fact that the catch lever acts from below on the film covering apparatus or the subcomponent and, on further upward movement of the drive, by way of a non-positive connection provides for the raising of the component. In this case, a fixed connection is not absolutely necessary. A particularly more simple design of the drive coupling is thus provided.

It may be advantageous for at least one positioning coupling device to be designed in such a manner that the operative connection of the machine frame can be released by raising the covering apparatus or the at least one subcomponent of the film supply apparatus. The position coupling device can thus be pre-tensioned, for example by a spring, and pushed in the direction of the machine frame when the positioning coupling device is in engagement. As soon as the film covering apparatus or the film supply apparatus or the subcomponent thereof is raised by the drive, the positioning coupling device snaps in the direction of the machine frame because of the pre-tensioning of the spring and releases the operative connection between machine frame and covering apparatus or film supply apparatus. A mechanism that is released when the component itself is raised has the advantage that an additional control of the positioning coupling device is not necessary here. The release of the operative connection of the positioning coupling device is thus ensured in a simple and reliable form. Conversely, the closing of the positioning coupling device can likewise take place by way of a purely mechanical configuration. The positioning coupling device can have, for example, a type of catch that brings the positioning coupling device into engagement again as soon as the covering apparatus or the subcomponent moves past the positioning coupling device from the bottom upward. By way of the moving past from the bottom, the positioning coupling device is therefore mechanically brought into engagement again. Subsequently, the covering apparatus or the film supply apparatus can be deposited again onto the positioning coupling device.

It may be advantageous for the at least one positioning coupling device to have a bolt that can be brought into engagement in a recess on the machine frame to fix the relevant component. It is conceivable here to provide a multiplicity of recesses on the machine frame and thus to permit as flexible a positioning as possible. For this purpose, the film covering apparatus or the film supply apparatus is expediently moved first of all into the preferred maintenance position by way of the drive. At the desired location, the bolt is then brought into engagement in the corresponding recess on the machine frame to secure the film covering apparatus or the film supply apparatus on the machine frame at that position. The fitting of the bolt can take place here manually or else by a corresponding actuator. By way of the design of the positioning coupling device in the form of a bolt that can be brought into engagement with a corresponding recess on the machine frame, a particularly simple embodiment that is particularly low in maintenance is ensured. Firstly, the relevant component is securely fixed in a simple manner. Secondly, a multiplicity of positions are possible for rapid maintenance.

Expediently, the packaging apparatus has a controller that is configured in such a manner that the drive brings the film covering apparatus from an operating position into a maintenance position, the operative connection between film covering apparatus and drive is released there, the drive is then driven in such a manner that the drive coupling device is moved into a position in which the drive coupling device is then brought into operative connection with at least one subcomponent of the film supply apparatus, and then the at least one subcomponent of the film supply apparatus is brought from an operating position into a maintenance position. Film covering apparatus and also the at least one subcomponent of the film supply apparatus are therefore moved in each case separately into the maintenance position thereof by way of the drive of the film covering apparatus. Since the apparatuses and subcomponent are not moved together, but rather one behind another, the drive of the film covering apparatus and the machine frame can be configured and dimensioned to be very slim. The forces that the drive has to absorb are ideally not greater here than the dead-weight of the film covering apparatus. In other words, the drive is optimally dimensioned in respect of the film covering apparatus and the film supply apparatus is subsequently divided into so many subcomponents that the weight of the respective subcomponent does not exceed the weight of the film covering apparatus. It is thus ensured that the drive can also move the relevant subcomponent into a maintenance position without requiring larger dimensioning of the drive components.

The method of the present disclosure is distinguished in that the drive brings the film covering apparatus from an operating position into a maintenance position, the operative connection between film covering apparatus and drive is released there, the drive is then driven in such a manner that the drive coupling device is moved into a position in which the drive coupling device is then brought into operative connection with at least one subcomponent of the film supply apparatus, and then the at least one subcomponent of the film supply apparatus is brought from an operating position into a maintenance position.

Operating position is intended to be understood here as meaning the normal state of the apparatus when the apparatus is in the process of carrying out packaging or at least in principle would be capable of carrying out packaging. Maintenance position should be understood as meaning a position differing from the operating position.

The method according to the present disclosure therefore consists in moving film covering apparatus and at least one subcomponent of the film supply apparatus in a stepwise manner one behind the other from the respective operating position thereof into a maintenance position. For this purpose, according to the present disclosure, use is directly made of the drive of the film covering apparatus. In the operating mode, the film covering apparatus is moved to and fro by the drive thereof in the machine frame to be able to correspondingly pull the packaging film over the article. According to the present disclosure, by way of the drive, the film covering apparatus is now brought from an operating position into a maintenance position and the operative connection is separated there. Only by separating the operative connection is it possible to use the drive also for moving the at least one subcomponent of the film supply apparatus. The advantage of this method according to the present disclosure consists in that a narrow, slim and optimum dimensioning of the drive components, but also of the apparatus as a whole can take place. By way of the stepwise downward movement of film supply apparatus and of at least one subcomponent, the drive does not have to be dimensioned to be larger than is necessary in any case for the movement of the film covering apparatus. A slim, weight- and material-saving design is thereby possible. Accordingly, it is possible to move the film covering apparatus and the subcomponent(s) of the film supply apparatuses into a maintenance position and thus to be able to work safely and ergonomically thereon.

It may be expedient here for the method to be repeatedly carried out in such a manner that the film covering apparatus and/or at least one subcomponent of the film supply apparatus is or are brought into different maintenance positions. This permits an even safer, more efficient, and more ergonomic maintenance of the packaging apparatus. It is thus possible, for example, first of all to move the film covering apparatus into a first maintenance position in which a fitter, for example, can maintain the reefing fingers because the reefing fingers are then precisely located at standing height of the fitter. Subsequently, the film covering apparatus is then, for example, entirely lowered and subsequently, for example, the cutting apparatus is lowered to the extent required by the fitter. The optimum position in each case can then be approached also for further components of the film supply apparatus. Safe, rapid, and efficient maintenance of the system is thereby possible.

The present disclosure is explained in more detail below with reference to an exemplary embodiment illustrated schematically in the drawings.

Figure 1:
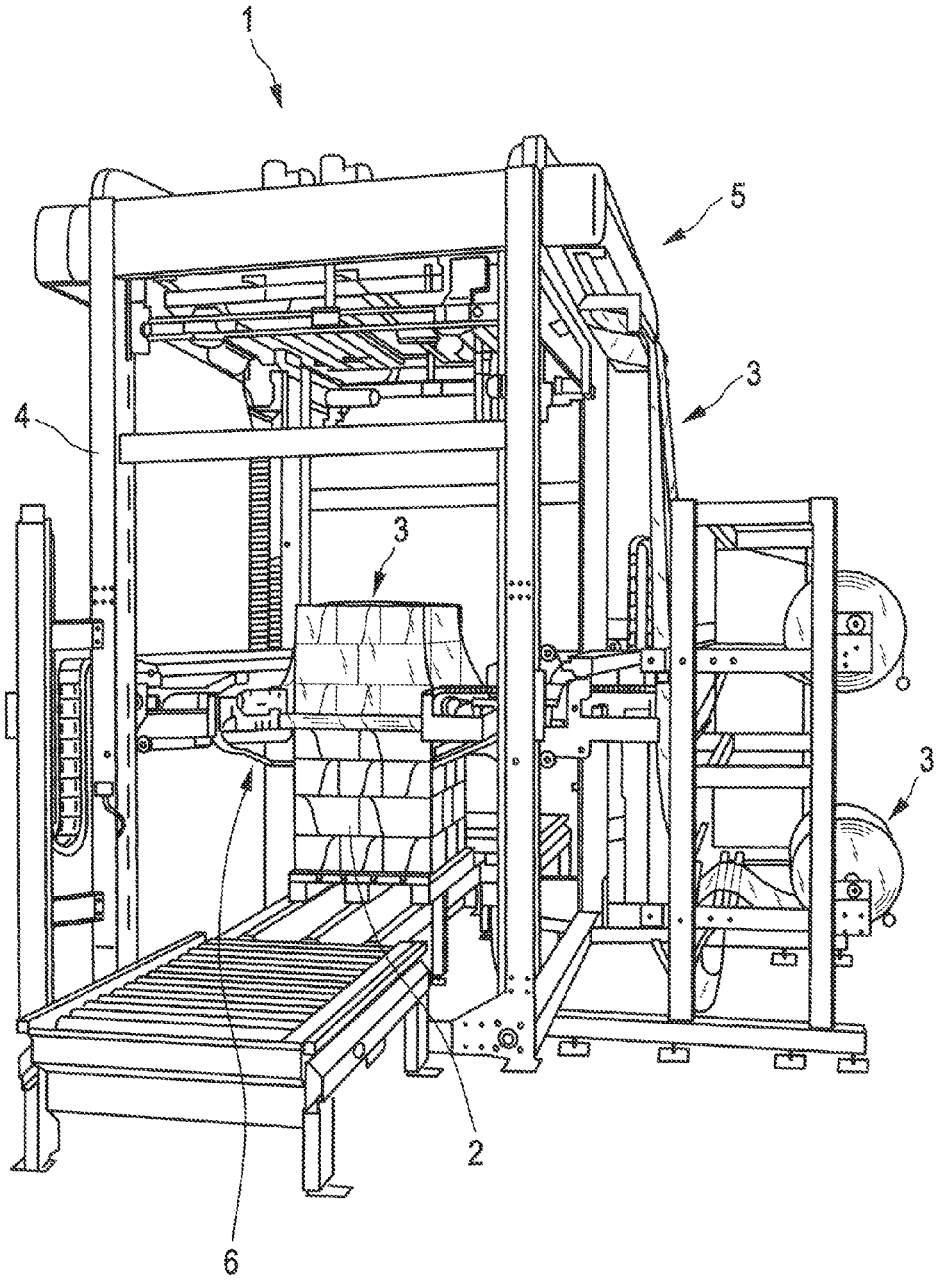
FIG. 1 shows a perspective overall view of a packaging apparatus of the present disclosure.

FIG. 1 shows a perspective overall view of a packaging apparatus 1 of the present disclosure for packaging an article 2 with a tubular film 3. The packaging apparatus 1 has a film stock in the form of a rolled tubular film 3. To produce and feed in the film, the packaging apparatus 1 has a film supply apparatus 5 that is arranged in the upper region of a machine frame 4 of the packaging apparatus 1. The film supply apparatus 5 has subcomponents, such as film feed apparatus, film opening apparatus, cutting apparatus, and welding apparatus (not illustrated explicitly).

For maintenance and/or installation purposes, it is sometimes necessary here to move the film covering apparatus 6 and/or the film supply apparatus 5 or a subcomponent of the film supply apparatus 5 into a maintenance position. Since the packaging apparatus 1 is generally some meters high, it is difficult, under some circumstances, for a fitter to reach all of the components of the packaging apparatus 1. Therefore, according to the present disclosure, both the film covering apparatus 6 and at least one subcomponent of the film supply apparatus 5 can be moved into a maintenance position, as shown in FIG. 2 to FIG. 17.

It is now first of all explained in FIG. 2 to FIG. 8 how the film covering apparatus 6 is moved by way of the drive 7 into a maintenance position. It is subsequently explained in FIG. 9 to FIG. 17 how the film supply apparatus 5 or the subcomponent thereof is subsequently also moved by way of the drive 7 into a maintenance position.

Figure 2:
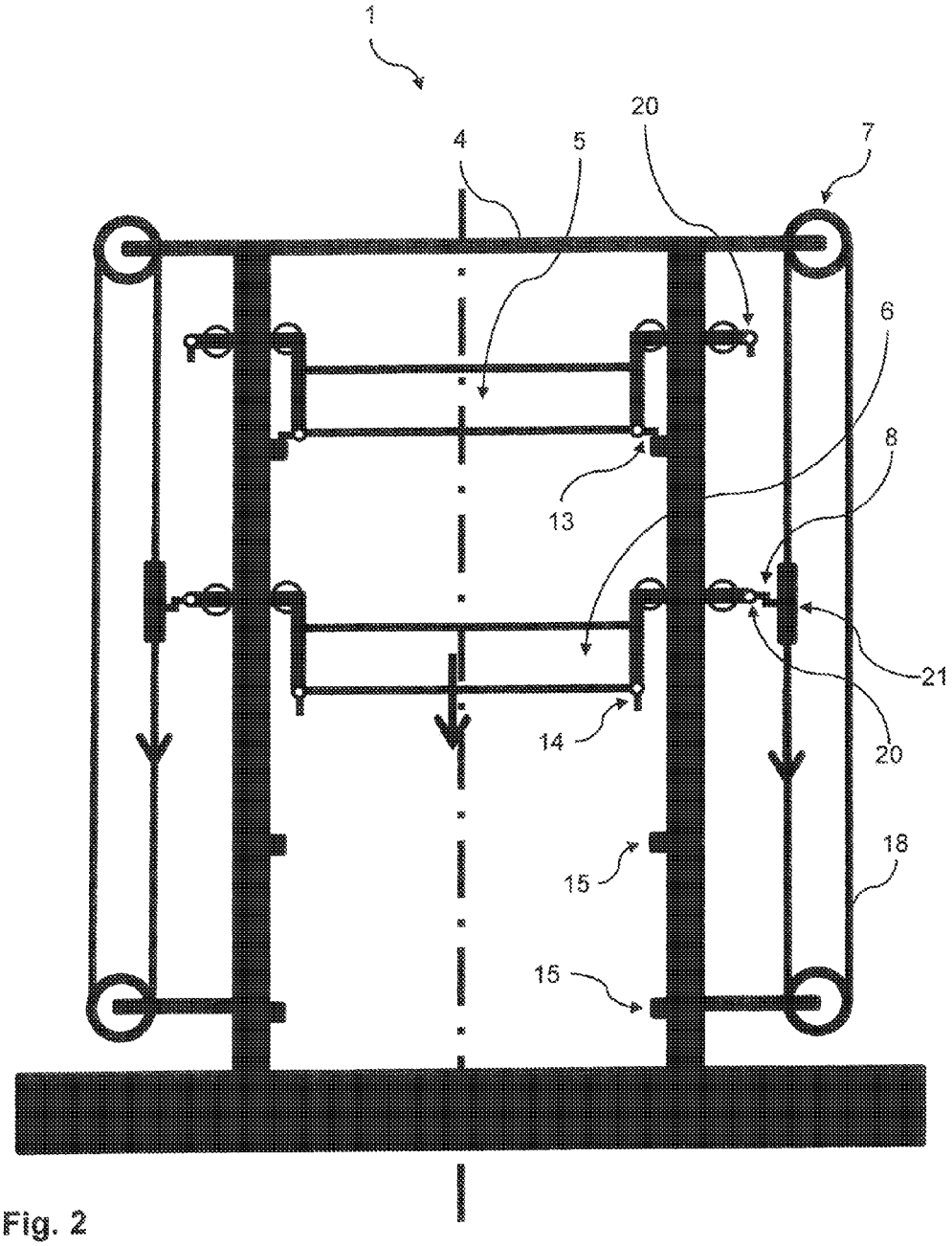
FIG. 2 to FIG. 8 show a simplified side view of a packaging apparatus of the present disclosure, showing the individual steps of lowering the film covering apparatus from an operating position into a maintenance position.

FIG. 2 shows a side view of the packaging apparatus 1 with the machine frame 4. The film covering apparatus 6 is fastened to the machine frame 4 so as to be movable in a vertical direction. The film covering apparatus 6 is connected to a drive belt 18 of a drive 7 by way of a drive coupling 8. However, solutions with a drive cable and/or a drive belt are also conceivable. The drive 7 can take place here by motor or else hydraulically and/or pneumatically by way of a drive piston. The drive can be arranged at the top or at the bottom or at another suitable position of the machine frame 4.

In the present example, the drive coupling 8 has a catch lever 20 that is mounted on the film covering apparatus 6. A counterpart 21, for example a bushing, that is in engagement with the catch lever 20 when the catch lever 20 is in an extended state is mounted on the drive belt/chain/cable 18. In FIG. 2, the catch lever 20 is in the extended state and is therefore in operative connection with the counterpart 21. By way of the drive coupling 8, it is therefore possible to move the film covering apparatus 6 on the machine frame 6.

Figure 3:
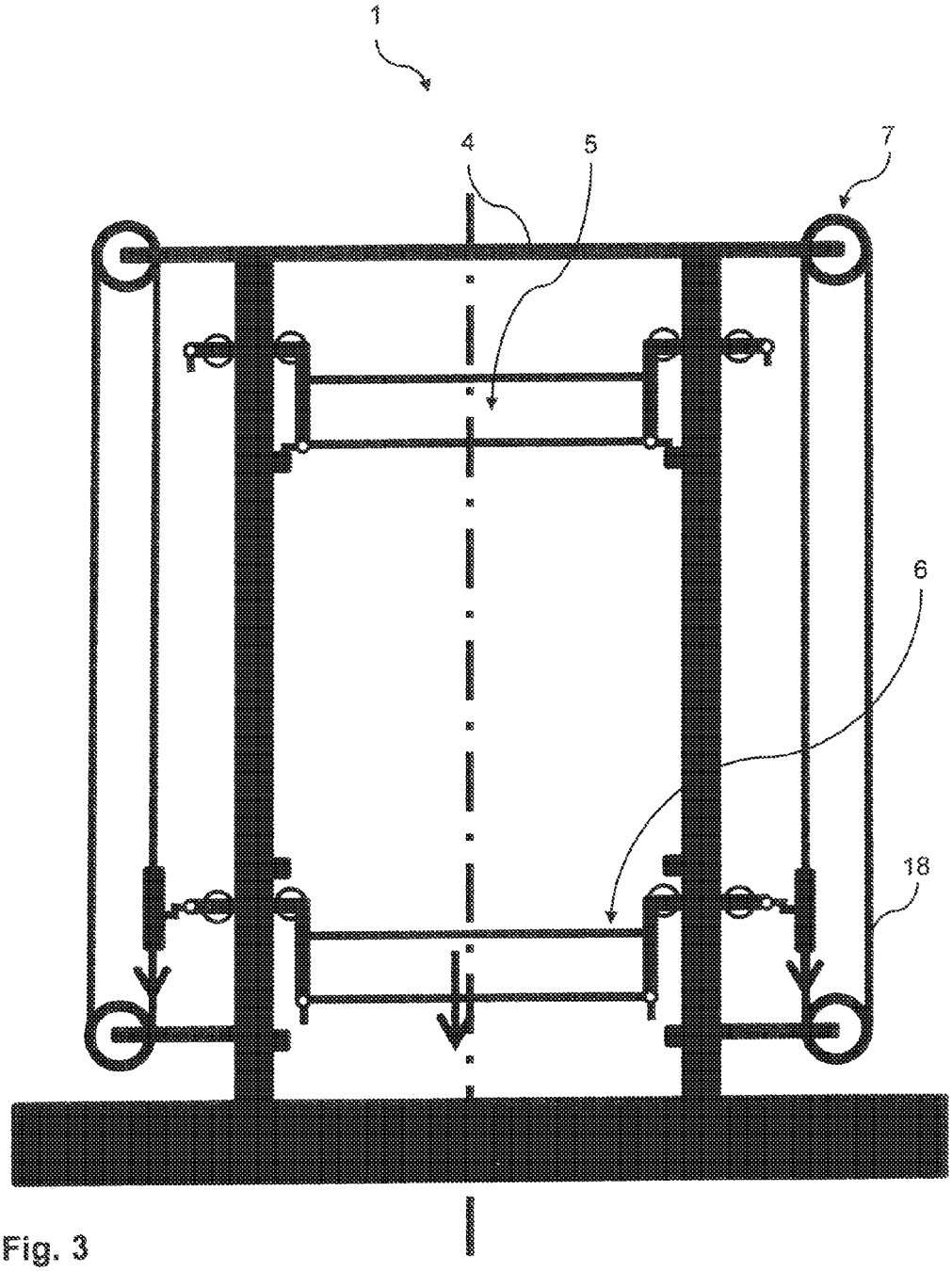

FIG. 3 shows a schematic side view according to FIG. 2, wherein the film covering apparatus 6 is now in a lowered position and is intended to be brought into a maintenance position.

Figure 4:
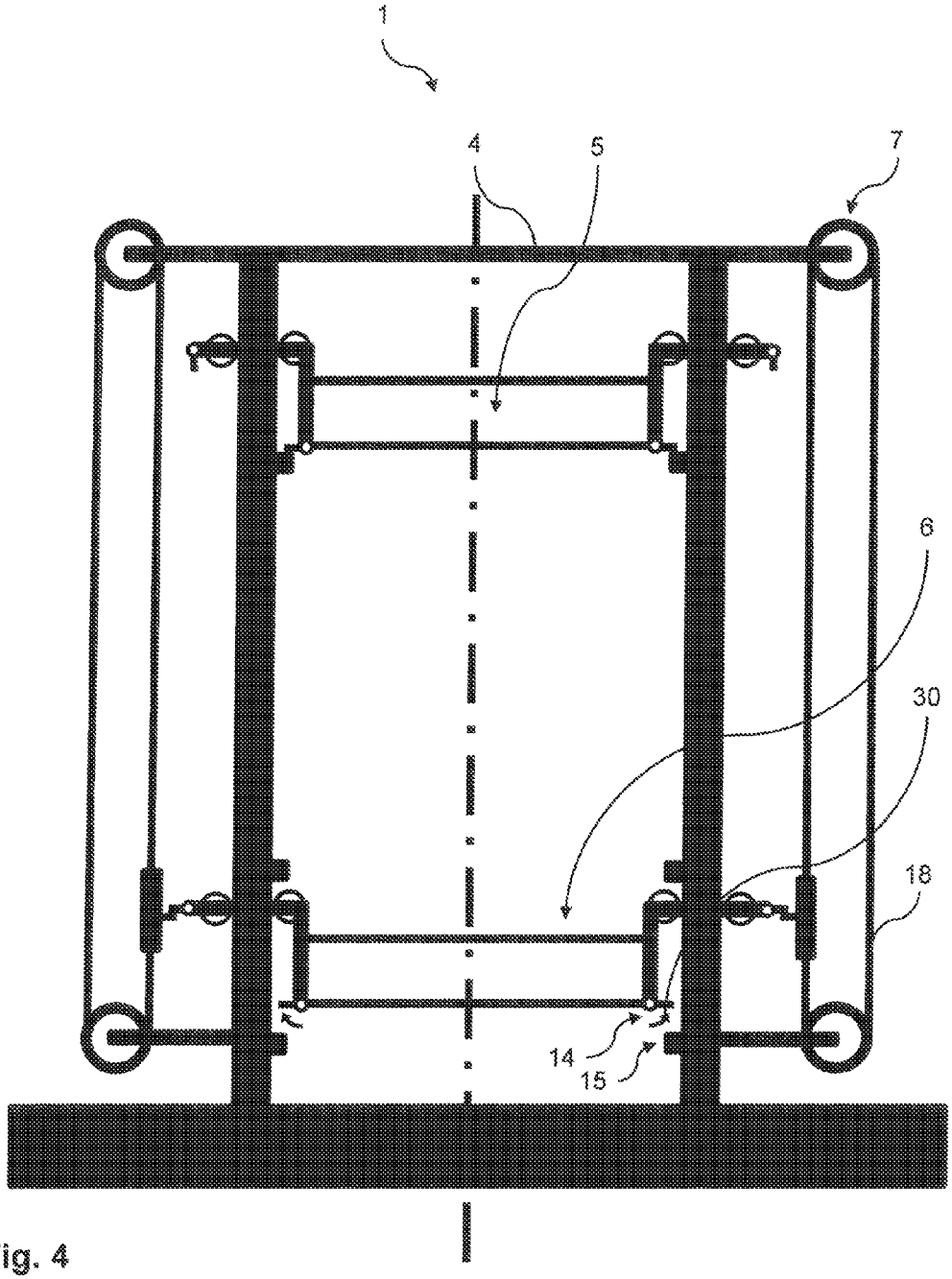

As can be seen in FIG. 4, the film covering apparatus 6 has positioning coupling devices 14. In the present exemplary embodiment, these are pivotable levers that can be moved, for example, by a hydraulic drive (not illustrated). The movable levers are activated via a controller of the packaging apparatus. As indicated in FIG. 4 by the curved arrows 30, the positioning coupling devices 14 of the film covering apparatus 6 are moved into an engagement position. However, the positioning coupling devices 14 do not absolutely have to be formed by movable parts of this type. Instead of the pivotable lever, it is thus also possible, for example, for a rigid projection also to be arranged on the film covering apparatus 6.

Figure 5:
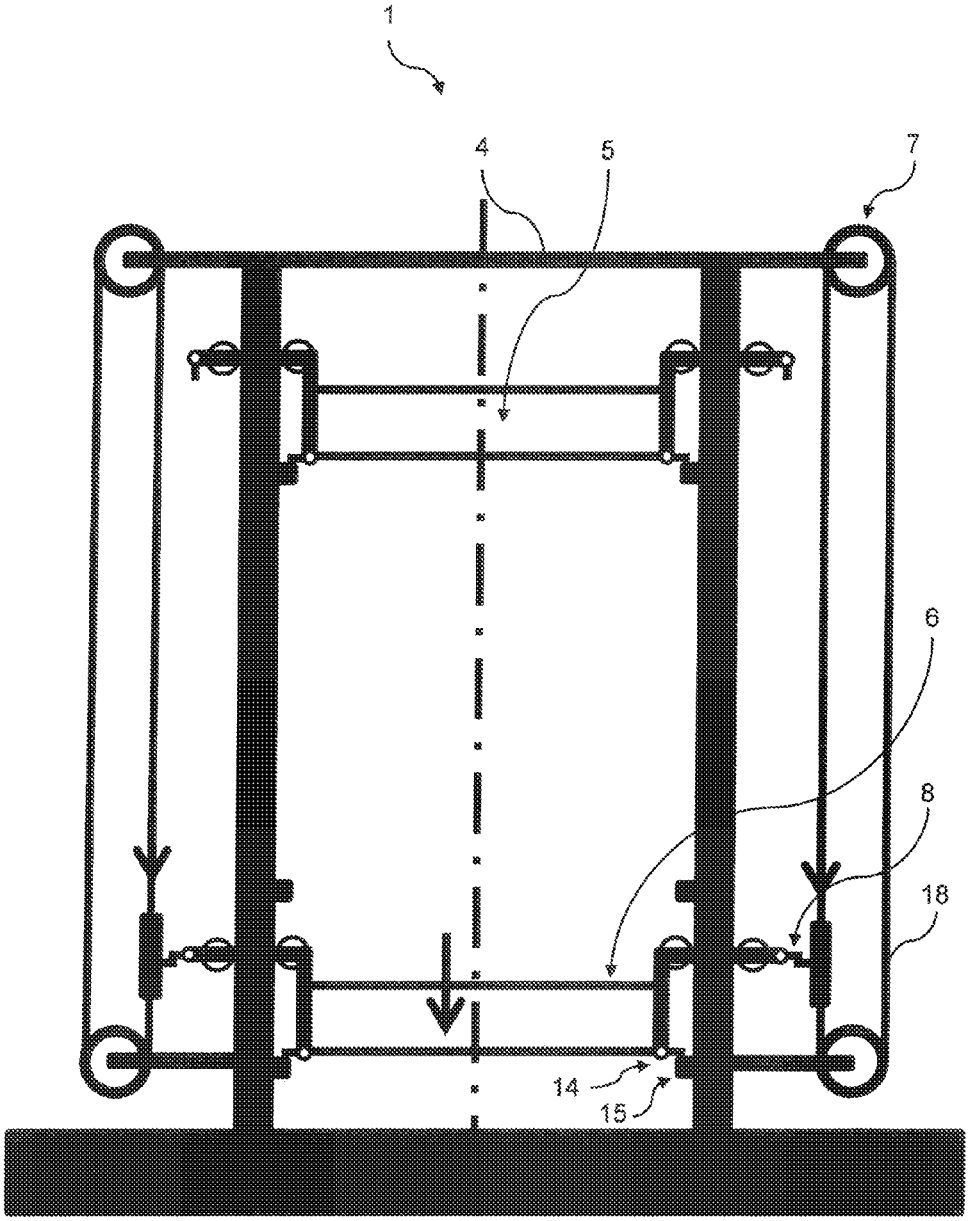

As illustrated in FIG. 5, the film covering apparatus 6 is subsequently lowered further by way of the drive 7, as a result of which the positioning coupling devices 14 sit on mountings 15 mounted on the machine frame 4. The film covering apparatus 6 is now in the maintenance position thereof. If, instead of the pivotable lever, for example a rigid projection is arranged on the film covering apparatus 6, the projection sits correspondingly on the mounting 15. However, instead of on the mounting 15 on the machine frame 4, it may optionally also be expedient for the film covering apparatus to be deposited directly on a surface located under the film covering apparatus 1, for example on the floor of a workshop.

Figure 6:
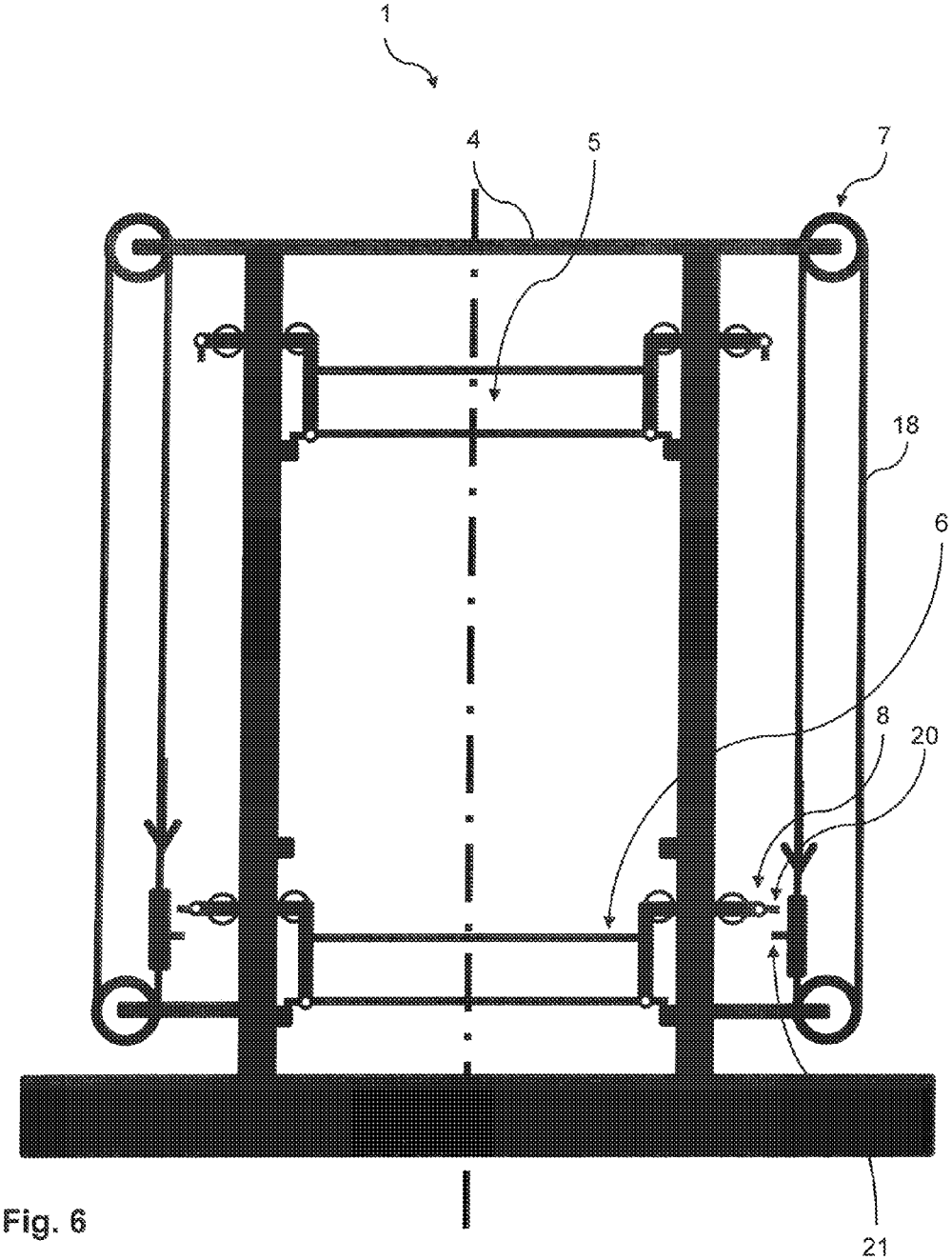

As can be seen in FIG. 6, the operative connection between drive 7 and film covering apparatus 6 is released as soon as the film covering apparatus 6 is in the maintenance position thereof. The drive coupling 8 s responsible for this purpose. In the present case, the drive 7 initially moves further downward by a distance in order thereby to relieve the catch lever 20 of load.

Figure 7:
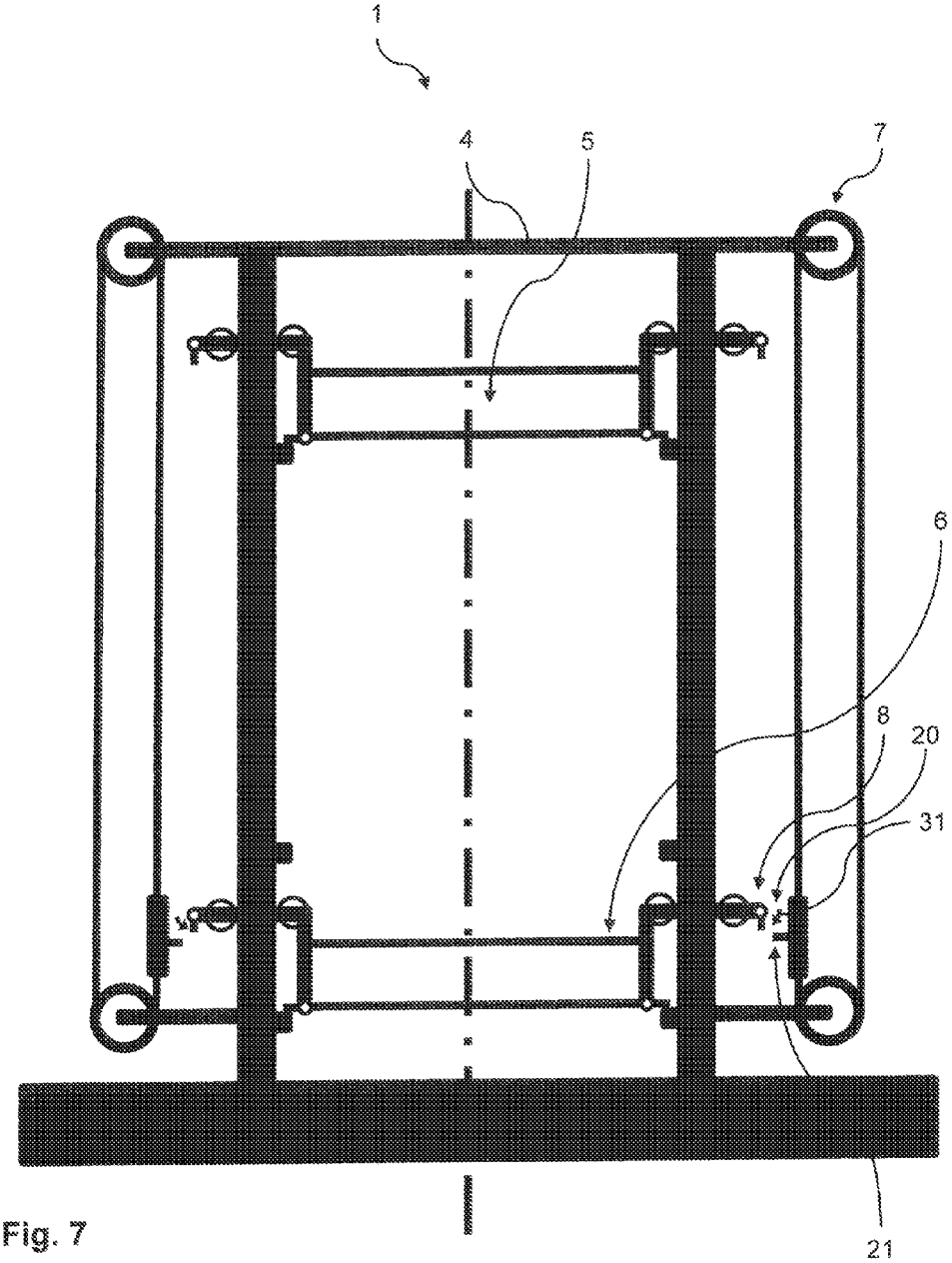
Figure 8:
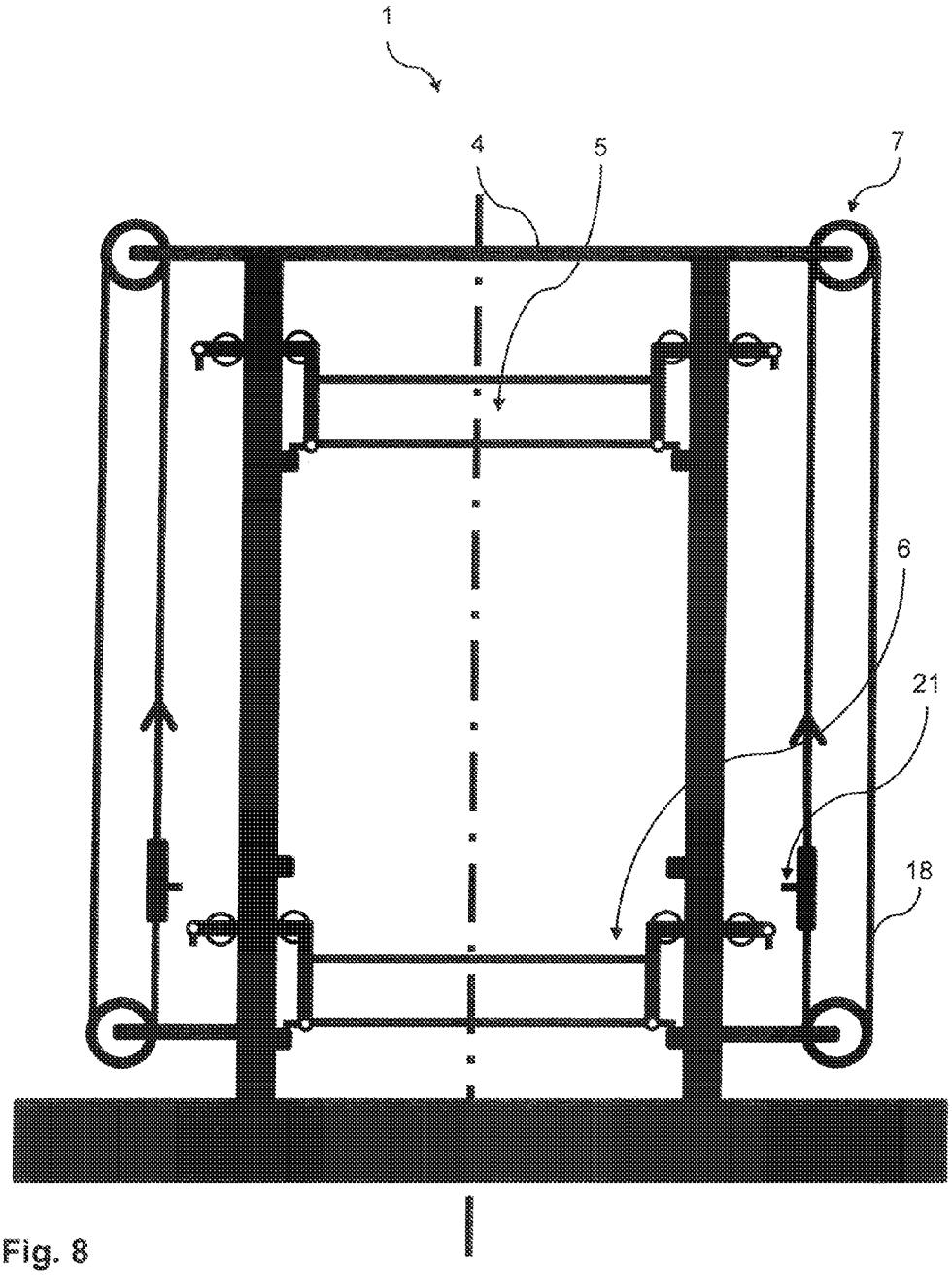

As can be seen in FIG. 7, the catch lever 20 of the film covering apparatus 6 is subsequently moved into a retracted position, as is indicated by the curved arrows 31. This takes place, for example, by way of a pneumatic piston that is connected (not illustrated) to the pivotable catch lever 20. By the pivoting of the catch levers 20 into a retracted position, it is subsequently possible to move the drive 7 together with counterpart 21 upwards on the machine frame 4 without the drive transporting the film covering apparatus 6 upward at the same time. On the contrary, the film covering apparatus 6 continues to remain in the maintenance position thereof, as can be seen in FIG. 8.

It is now explained in FIG. 9 to FIG. 17 how the film supply apparatus 5 or a subcomponent of the film supply apparatus 5 is now also moved by way of the drive 7 into a maintenance position.

Figure 9:
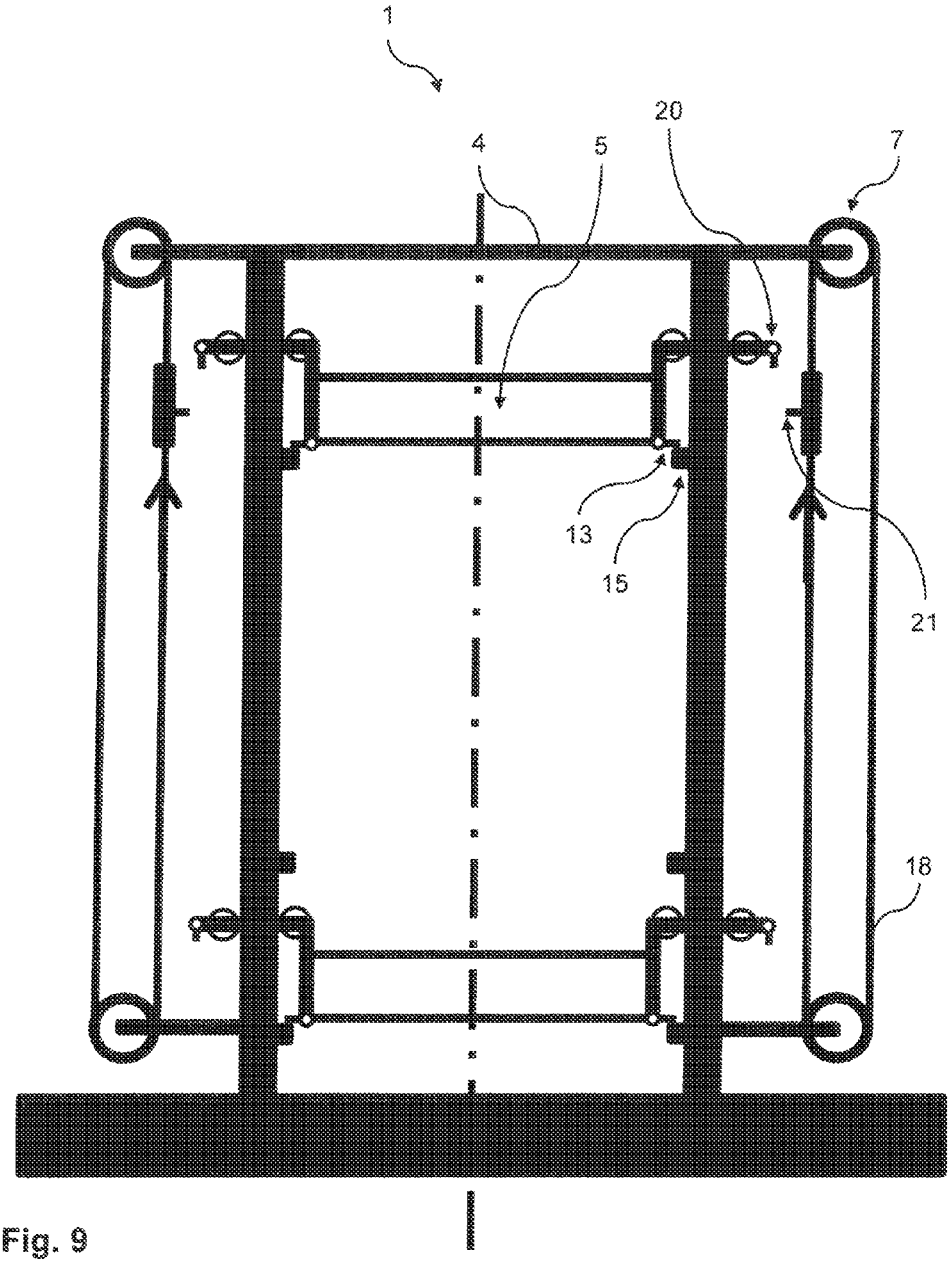
FIG. 9 to FIG. 17 show a simplified side view of a packaging apparatus of the present disclosure, showing the individual steps of the lowering of the film supply apparatus from an operating position into a maintenance position.

In FIG. 9, the film supply apparatus 5 is illustrated still in the operating position thereof—and therefore fastened to the upper end of the machine frame 4.To fasten the film supply apparatus 5 to the machine frame 4, use is made of positioning coupling devices 13. These can be pivotable levers that is moved, for example, by way of pneumatics. A controller takes over the targeted activation of the lever. As can be seen in FIG. 9, the positioning coupling devices 13 are initially in an extended state. As a result, the film supply apparatus 5 is in operative connection with a mounting 15 on the machine frame 4.

Figure 10:
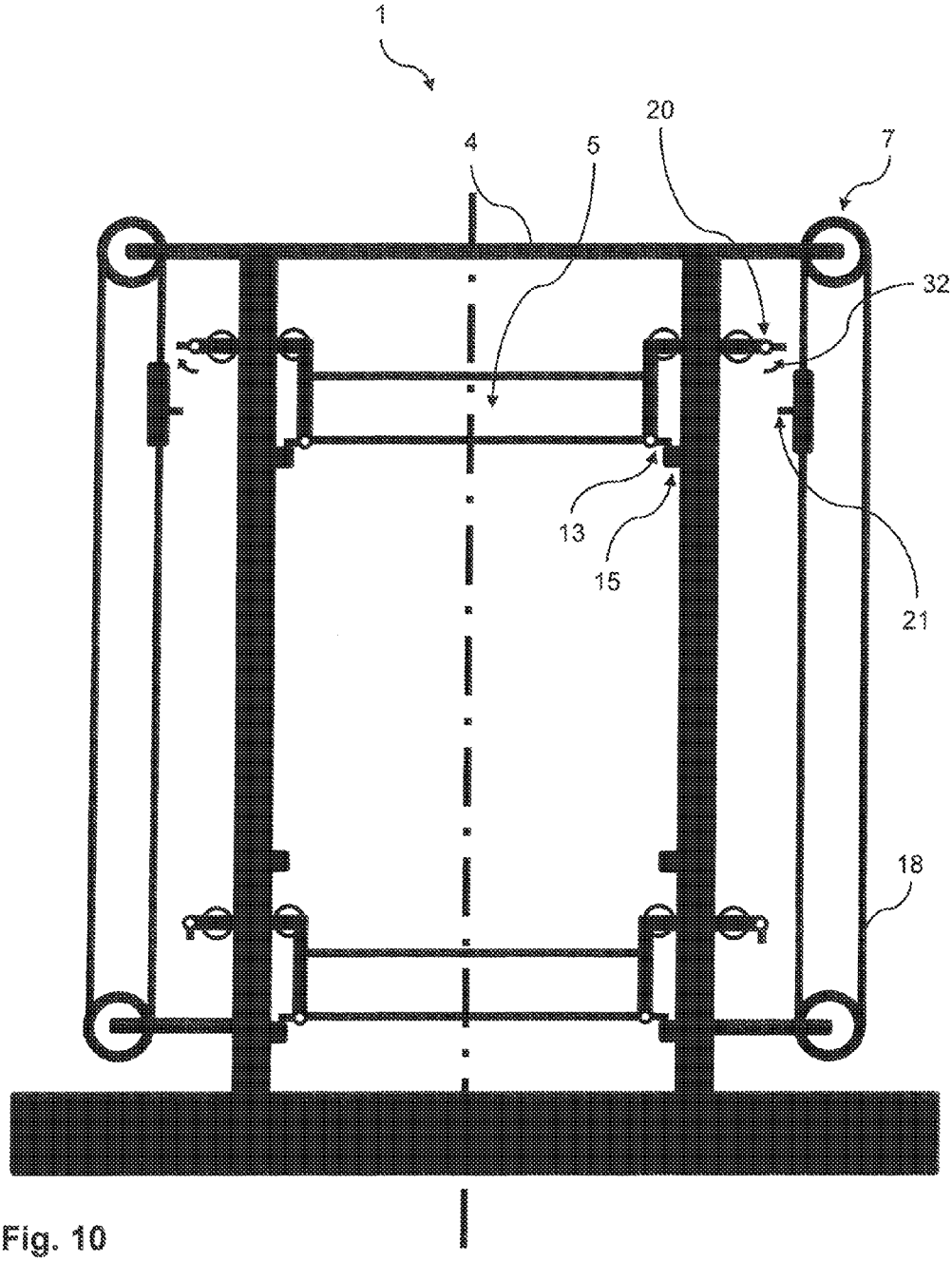
Figure 11:
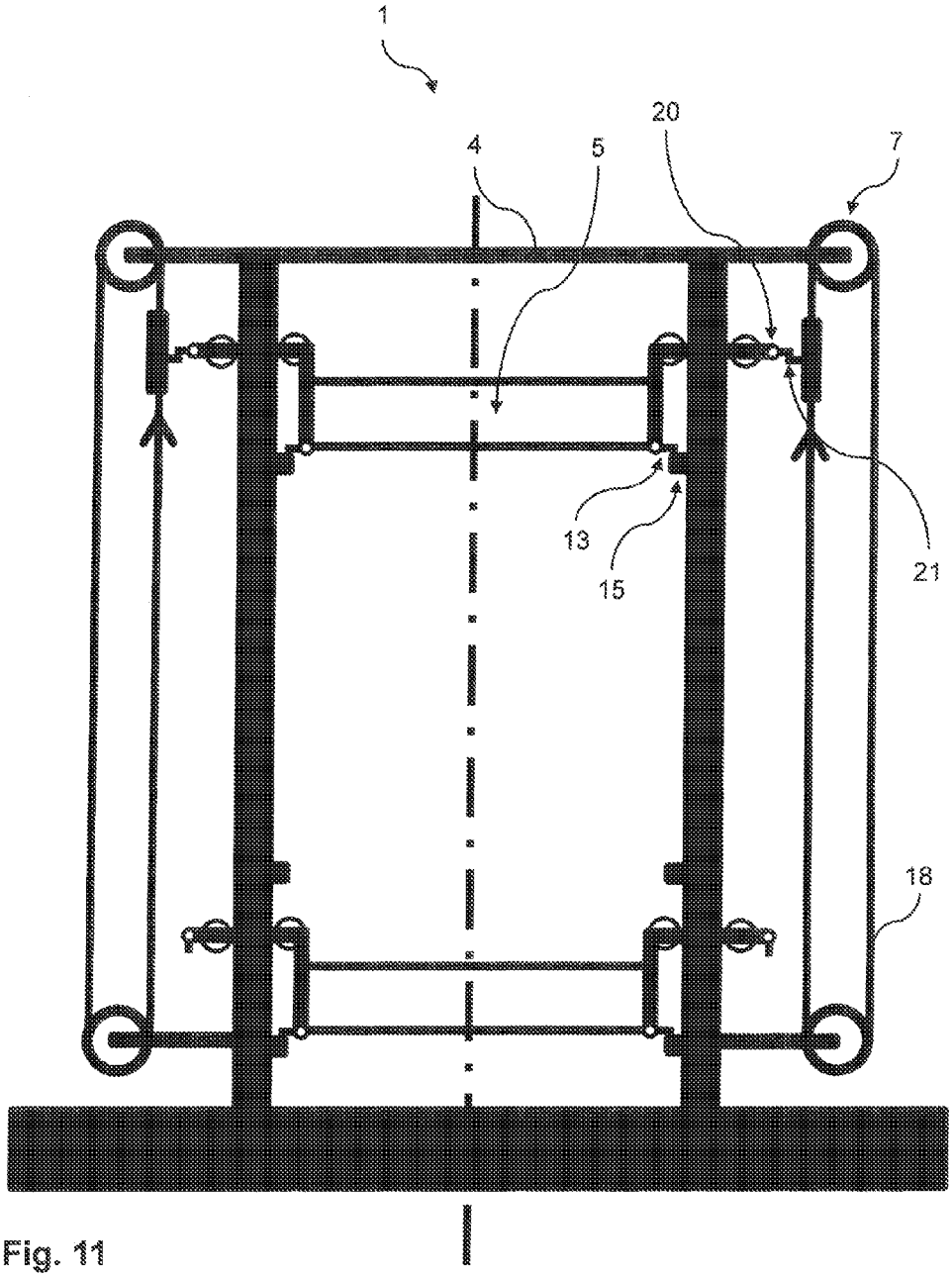

To produce an operative connection between the film supply apparatus 5 and the drive 7, the film supply apparatus 5, similarly to the film covering apparatus 6, has a catch lever 20. The catch lever 20 is also pivotable and is movable in a targeted manner by a controller. To produce the engagement between the catch lever 20 and the drive 7, the catch lever 20 of the film supply apparatus 5 is first of all brought into an extended position. This is illustrated in FIG. 10 and is indicated by the curved arrows 32. Subsequently, the drive 7 together with the counterpart 21 mounted thereon is moved further upward until the catch lever 20 and the counterpart 21 come into engagement. This is illustrated in FIG. 11. However, analogously to the positioning coupling devices 14, the positioning coupling devices 13 also do not absolutely have to be formed by movable parts. Instead of the pivotable lever, it is, for example, also possible for a rigid projection to be arranged on the film supply apparatus 5, which projection comes into engagement with the counterpart 21.

Figure 12:
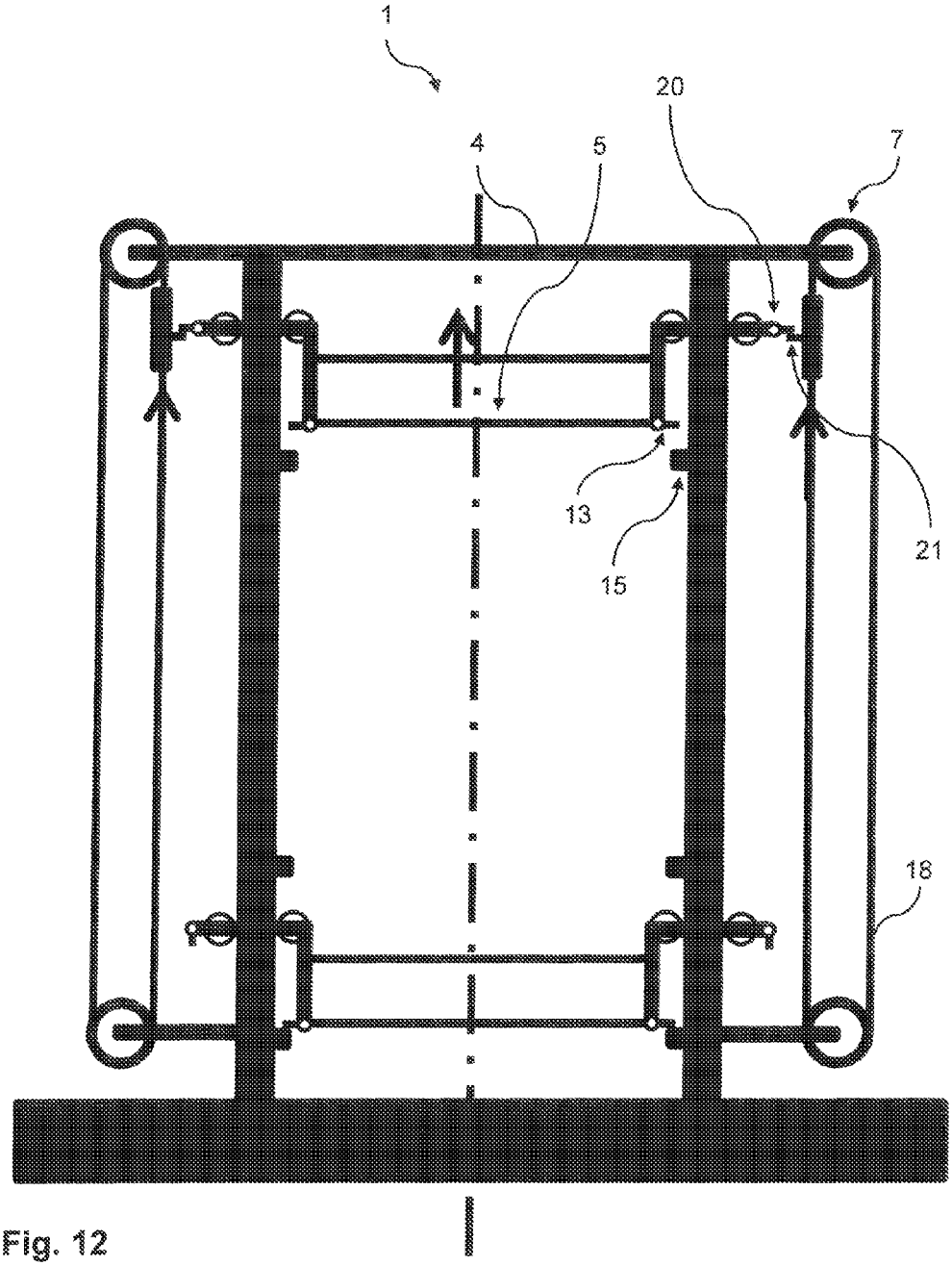
Figure 13:
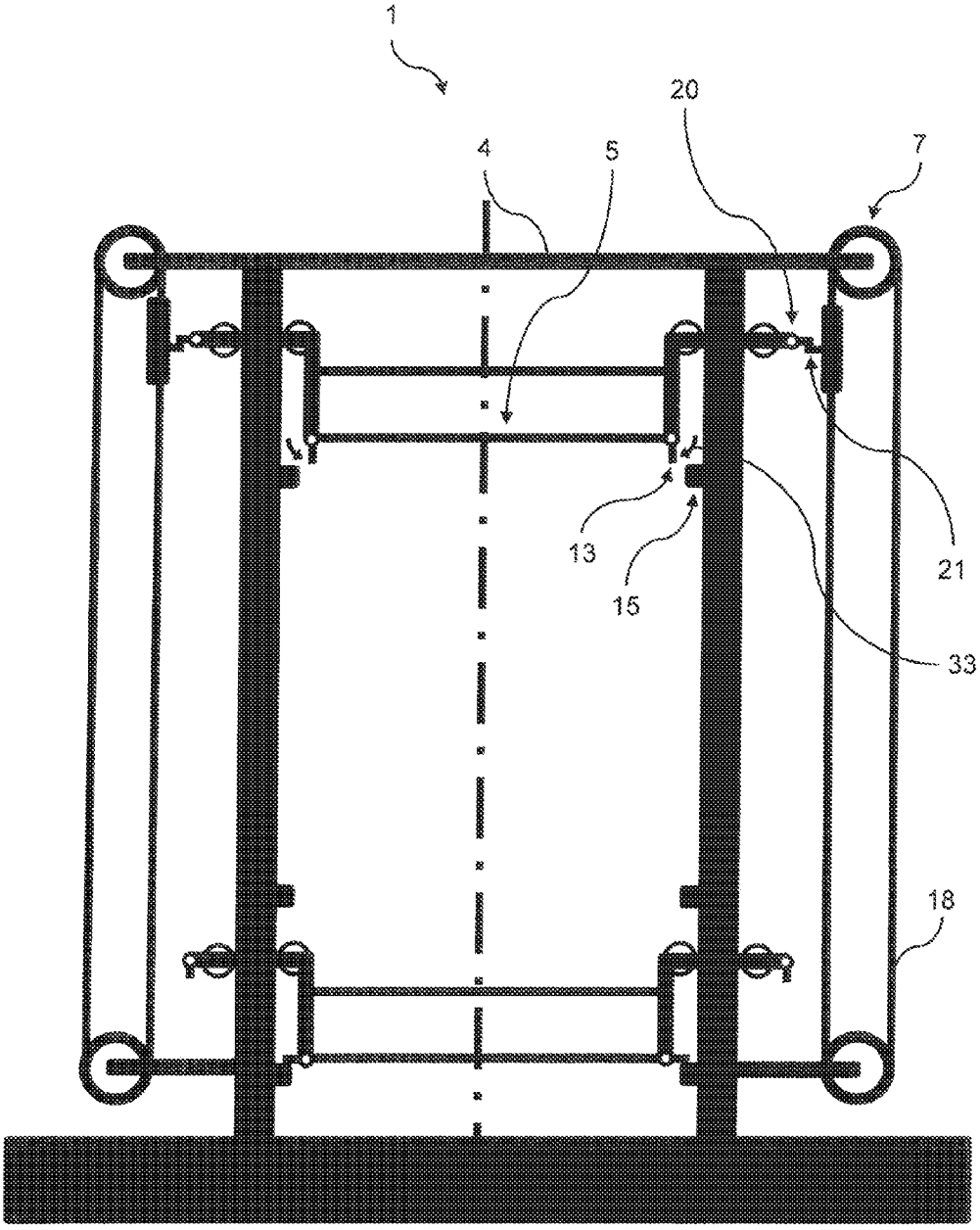
Figure 14:
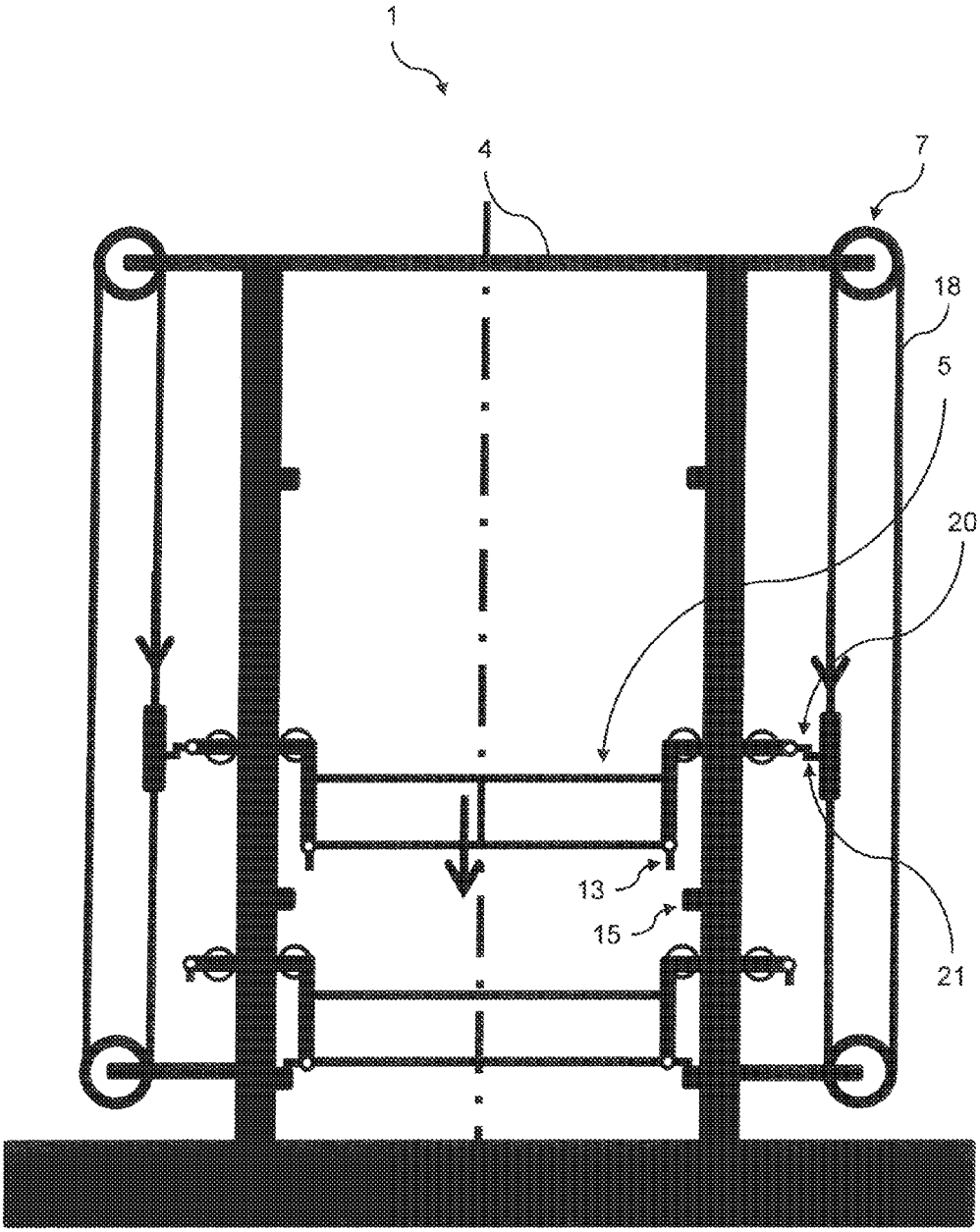

By further movement of the drive 7 upward, the film supply apparatus 5 is raised and, as a result, the positioning coupling devices 13 are relieved of load, as can be seen in FIG. 12. Only when the positioning coupling devices 13 have been relieved of load is it possible for the positioning coupling devices 13 to move from an extended position into a retracted position, as illustrated in FIG. 13 and indicated by the curved arrows 33. By way of the retraction of the positioning coupling devices 13, the possible contact between the positioning coupling devices 13 and the mountings 15 on the machine frame 4 is canceled. It is thus possible to lower the film supply apparatus 5 along the machine frame 4 with the aid of the drive 7. This is illustrated in FIG. 14.

Figure 15:
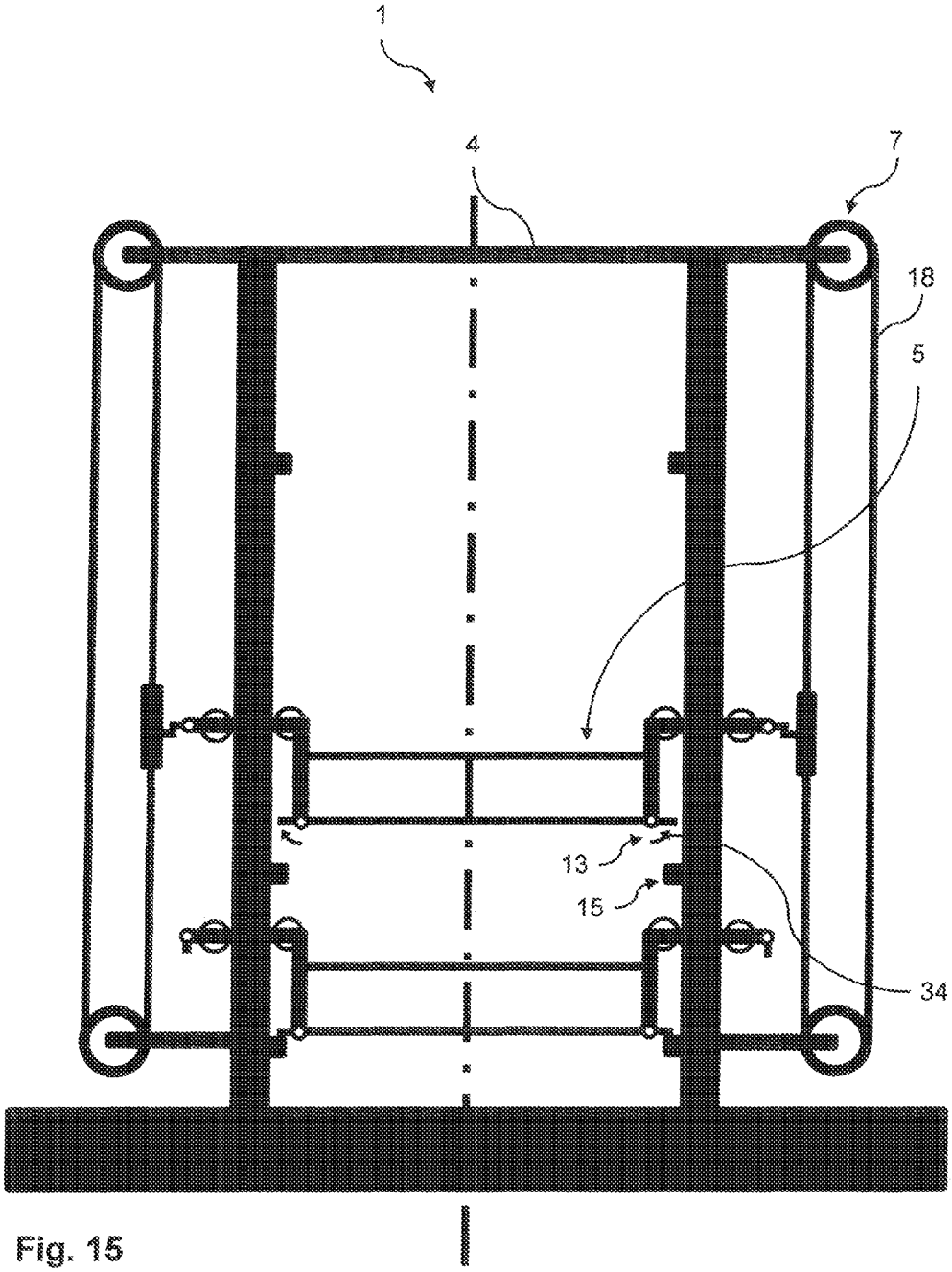
Figure 16:
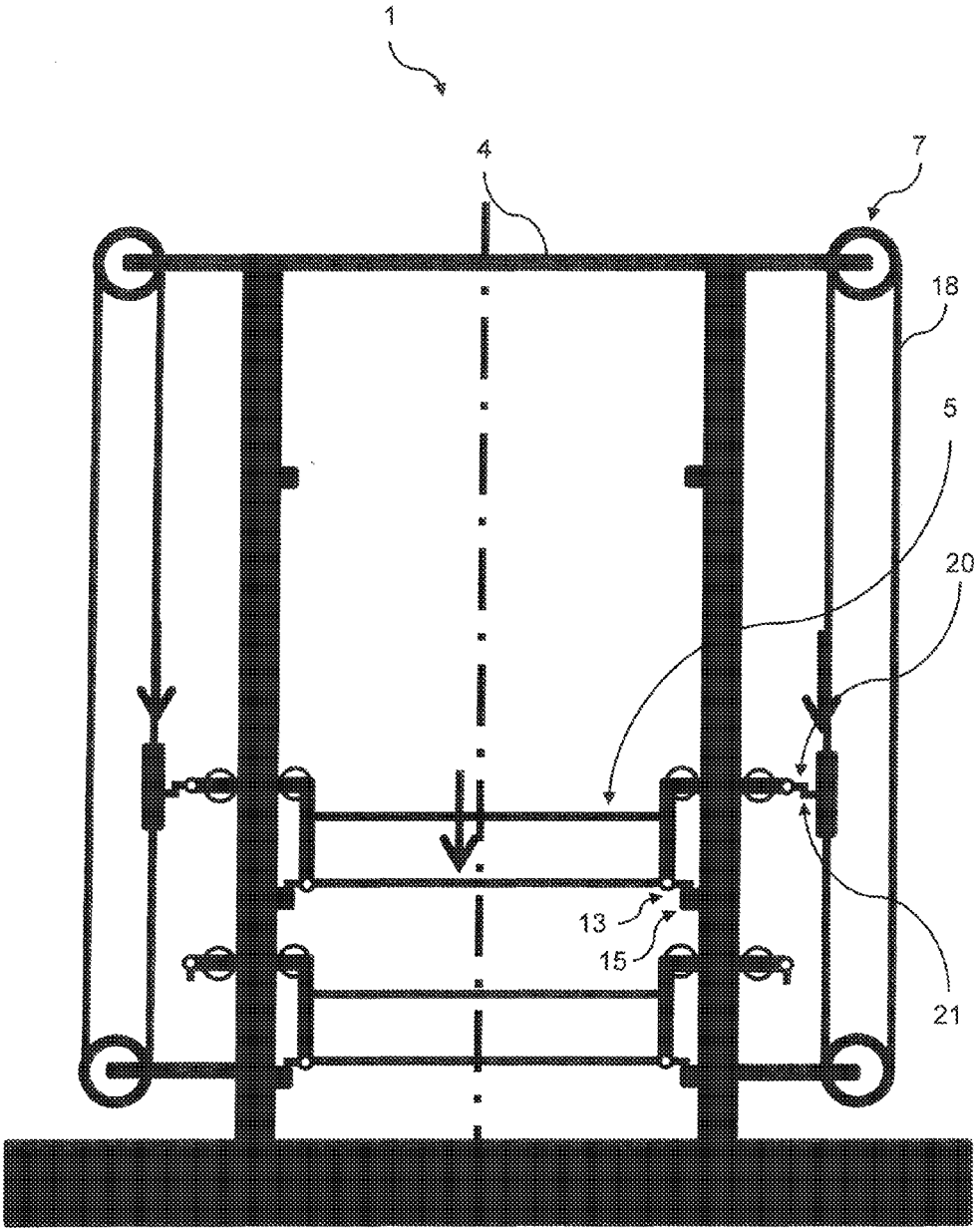
Figure 17:
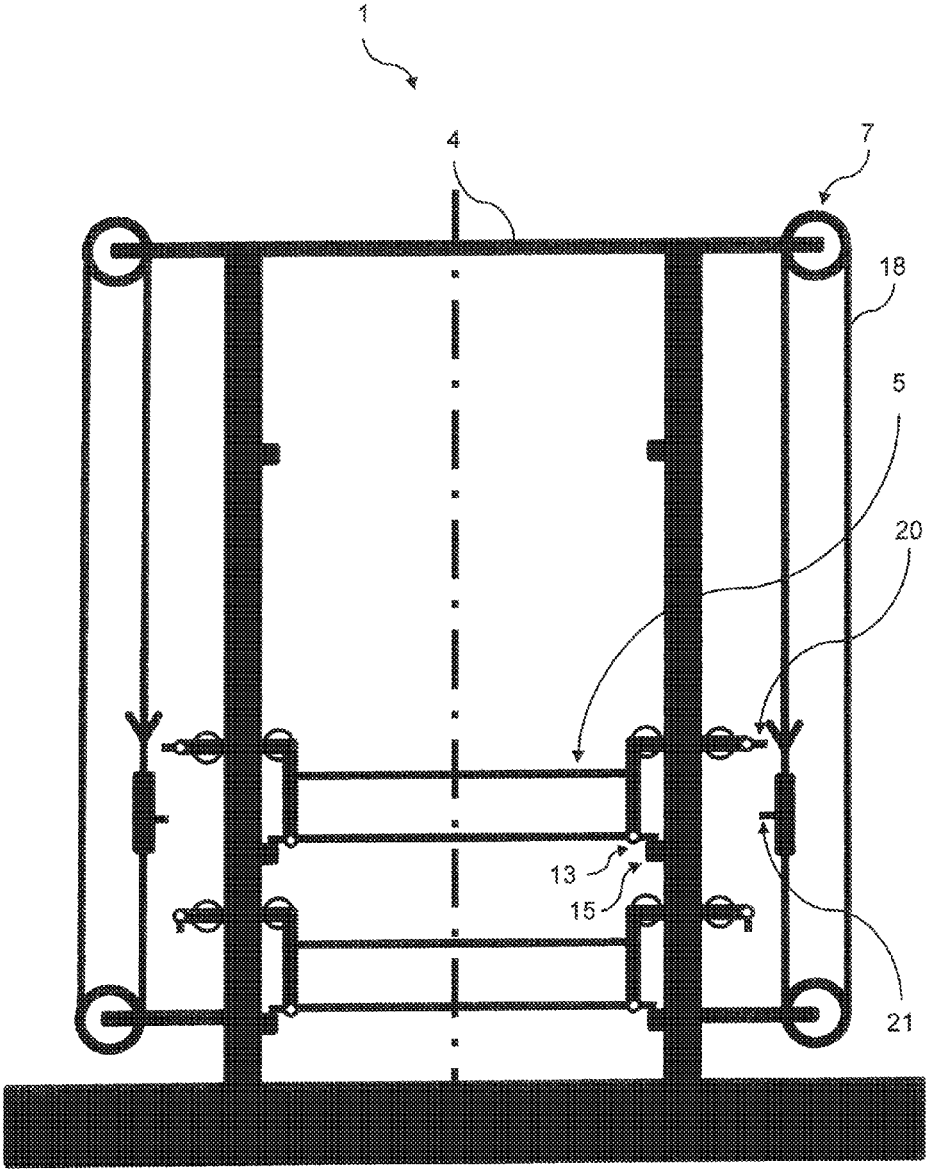

To relieve the drive 7of load during the maintenance of the film supply apparatus 5, the film supply apparatus 5 is also brought in the maintenance position thereof into operative connection with the machine frame 4 again. This again takes place with the positioning coupling devices 13. For this purpose, the positioning coupling devices 13 are moved, for example by way of pneumatics, into an extended position shortly before the film supply apparatus 5 is moved in the maintenance position thereof. This is illustrated in FIG. 15 and is indicated by the curved arrows 34. In the present case, mountings 15 are in turn mounted on the machine frame 4 level with the machine frame on which the film supply apparatus 5 is intended to be positioned for maintenance. The extended positioning coupling devices 13 ensure that the film supply apparatus 5 can be deposited on the mounting 15, as shown in FIG. 16. As a result, the drive 7 can be relieved of load and the maintenance to the film supply apparatus 5 can be carried out safely. The unloaded state of the drive 7 is illustrated in FIG. 17.

To bring the packaging apparatus 1 from the maintenance position thereof again into an operating position, the sequence described in FIG. 2 to FIG. 17 takes place analogously, but in a reverse sequence.

The described illustrations merely show a schematic and basic illustration of the packaging apparatus of the present disclosure. Many other variants are also conceivable. For example, numerous mountings can be arranged on the machine frame to permit a multiplicity of possible maintenance positions for the film supply apparatus and the film covering apparatus. It is also possible for the film supply apparatus to have a plurality of separately-movable components. Analogous to the exemplary embodiment shown and described above, a first subcomponent of the film supply apparatus could then be moved into a maintenance position and, thereafter and in the same manner, a plurality of other subcomponents could then be moved into a maintenance position in subsequent steps.

Various changes and modifications to the presently preferred embodiments described herein will be apparent to those skilled in the art. These changes and modifications can be made without departing from the spirit and scope of the present subject matter and without diminishing its intended advantages. It is intended that such changes and modifications be covered by the appended claims.

While the features, methods, devices, and systems described herein may be embodied in various forms, there are shown in the drawings, and have been described, some exemplary and non-limiting embodiments. Not all of the depicted components described in this disclosure may be required, however, and some implementations may include additional, different, or fewer components from those expressly described in this disclosure. Variations in the arrangement and type of the components; the shapes, sizes, and materials of the components; and the manners of attachment and connections of the components may be made without departing from the spirit or scope of the claims as set forth herein. This specification is intended to be taken as a whole and interpreted in accordance with the principles of the invention as taught herein and understood by one of ordinary skill in the art.

LIST OF REFERENCE NUMBERS

| | |
|---|---|
| 1. | Packaging apparatus |
| 2. | Article |
| 3. | Film |
| 4. | Machine frame |
| 5. | Film supply apparatus |
| 6. | Film covering apparatus |
| 7. | Drive |
| 8. | Drive coupling |
| 13. | First positioning coupling device |
| 14. | Second positioning coupling device |
| 15. | Mounting |
| 18. | Drive belt/chain/cable/piston |
| 20. | Catch lever |
| 21. | Counterpart |

The invention is claimed as follows:

1. A packaging apparatus for packaging at least one article with a tubular film, the packaging apparatus comprising:

a frame;

a film supply apparatus supported by the frame, the film supply apparatus including a subcomponent;

a film covering apparatus supported by the frame;

a drive;

a first drive coupling device operatively connectable to the subcomponent and the drive, such that the drive is configured to move the subcomponent relative to the frame and relative to the film covering apparatus; and a second drive coupling device operatively connectable to the film covering apparatus and the drive to enable the drive to move the film covering apparatus relative to the frame.

2. The packaging apparatus of claim 1, wherein the first drive coupling device is actuatable to uncouple the subcomponent from the drive and the second drive coupling is actuatable to uncouple the film covering apparatus from the drive.

3. The packaging apparatus of claim 1, wherein the subcomponent includes at least one selected from the group consisting of: a film store, a film feed apparatus, a film opening apparatus, a cutting apparatus, and a welding apparatus.

4. The packaging apparatus of claim 1, wherein the film supply apparatus includes at least one positioning coupling device releasably engageable to the frame.

5. The packaging apparatus of claim 4, wherein raising the subcomponent of the film supply apparatus relative to the frame enables disengagement of the at least one positioning coupling device from the frame.

6. The packaging apparatus of claim 1, wherein the film covering apparatus includes at least one positioning coupling device releasably engageable to the frame.

7. The packaging apparatus of claim 6, wherein the positioning coupling device is releasably engageable to the frame at any of a plurality of different locations on the frame.

8. The packaging apparatus of claim 6, wherein the frame includes at least one recess, and wherein the packaging apparatus further includes an attachment device receivable in the recess to prevent the film covering apparatus from vertically moving relative to the frame.

9. The packaging apparatus of claim 1, wherein the frame includes at least one support surface engageable by the film covering apparatus.

10. The packaging apparatus of claim 1, wherein the drive includes: (1) one of a piston and a motor, and (2) a drive element including one of a drive chain, a drive cable, a linkage, and a drive belt.

11. The packaging apparatus of claim 10, wherein the film supply apparatus includes the first drive coupling device and the film covering apparatus includes the second drive coupling device.

12. The packaging apparatus of claim 11, wherein the first drive coupling device includes a first catch device and the second drive coupling device includes a second catch device.

13. The packaging apparatus of claim 12, wherein the drive element includes a drive catch device engageable to the first catch device to operatively connect the first drive coupling device to the drive and engageable to the second catch device to operatively connect the second drive coupling device to the drive.

14. The packaging apparatus of claim 13, wherein the first catch device and the second catch device are each movable between an engaged position in which they are engageable by the drive catch device and a disengaged position in which they are not engageable by the drive catch device.

15. A packaging apparatus for packaging at least one article with a tubular film, the packaging apparatus comprising:

a frame;

a film supply apparatus supported by the frame, the film supply apparatus including a subcomponent;

a film covering apparatus supported by the frame; and a drive releasably connectable to: (1) the subcomponent to move the subcomponent relative to the frame, and (2) the film covering apparatus to move the film covering apparatus relative to the frame, wherein when the drive is connected to the subcomponent, the drive is configured to move the subcomponent relative to the frame, the drive is not connected to the film covering apparatus, and the drive is not configured to move the film covering apparatus relative to the frame, wherein when the drive is connected to the film covering apparatus, the drive is configured to move the film covering apparatus relative to the frame, the drive is not connected to the subcomponent, and the drive is not configured to move the subcomponent relative to the frame.

16. A method of operating a packaging apparatus, the method comprising:

(1) coupling a film covering apparatus to a drive;

(2) moving, by the drive, the film covering apparatus from a film covering apparatus operating position to a film covering apparatus maintenance position;

(3) uncoupling the film covering apparatus and the drive;

(4) coupling a subcomponent of a film supply apparatus to the drive; and (5) without moving the film covering apparatus from the film covering apparatus operating position to the film covering apparatus maintenance position, moving, by the drive, the subcomponent from a film supply apparatus operating position to a film supply apparatus maintenance position.

17. The method of claim 16, wherein the film covering apparatus maintenance position and the film supply apparatus maintenance position are different.

18. The method of claim 16, which includes performing (4) and (5) after performing (1), (2), and (3).

19. The method of claim 16, which includes controlling the drive using a controller.

* * * * *